US006135840A

United States Patent [19]

Kanzaki

[11] Patent Number: 6,135,840

[45] Date of Patent: Oct. 24, 2000

[54] DISCHARGE LAMP OF THE SHORT ARC TYPE AND PROCESS FOR PRODUCTION THEREOF

[75] Inventor: Yoshitaka Kanzaki, Himeji, Japan

[73] Assignee: Ushiodenki Kabushiki Kaisha, Tokyo, Japan

[21] Appl. No.: 09/112,376

[22] Filed: Jul. 9, 1998

[30] Foreign Application Priority Data

Jul. 17, 1997 [JP] Japan ..... 9-207427

[51] Int. Cl.[7] ..... H01J 9/00

[52] U.S. Cl. ..... 445/26; 313/574

[58] Field of Search ..... 445/26, 39, 46; 313/574

[56] References Cited

U.S. PATENT DOCUMENTS 4,997,400 3/1991 Neff et al. ..... 445/26

FOREIGN PATENT DOCUMENTS 6-310030 4/1994 Japan .

*Primary Examiner*—Nimeshkumar D. Patel
*Assistant Examiner*—Todd Reed Hopper
*Attorney, Agent, or Firm*—Nixon Peabody LLP; David S. Safran

[57] ABSTRACT

A tipless discharge lamp of the short arc type in which on the outside surface of the arc tube there is no residual filling tube tip, and in which an exact distance between the electrodes is obtained is achieved in a metal halide lamp of the short arc type by a pair of electrodes being located in an arc tube, by the electrodes are parts of a one-piece electrode component that has been fracture-split so that, at least to some extent, fracture traces are present on the faces of these electrodes which have not undergone mechanical processing such as cutting, polishing, or the like, and elimination of the use of a filling tube, so that no residual filling tube tip projections remain on the outside surface of the arc tube. Furthermore, precise positioning of the pair of electrodes in the arc tube results from the hermetically sealed portion being drawn outwardly in the base area of at least one of the electrodes creating an area with a smaller diameter than the remainder of that hermetically sealed portion.

3 Claims, 3 Drawing Sheets

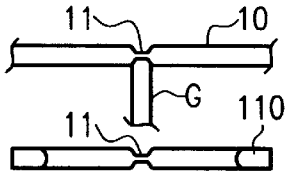

Process 1
(process of processing of the electrodes)

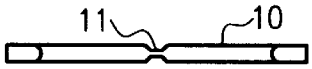

Process 2
(process of electrode treatment)

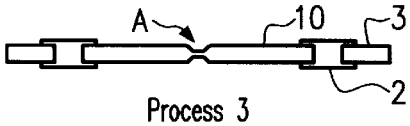

Process 3
(process of mounting the mounts)

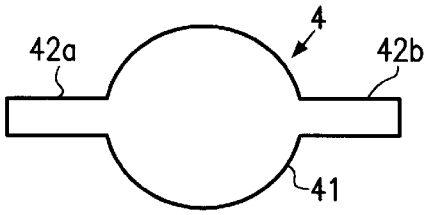

Process 4
(process of forming the arc tube)

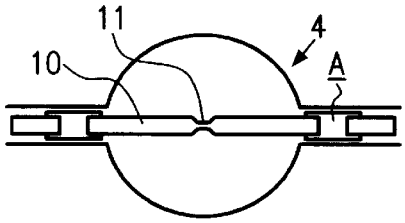

Process 5
(process of installing the mounts)

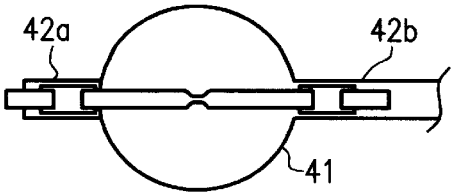

Process 6
(process of initial sealing)

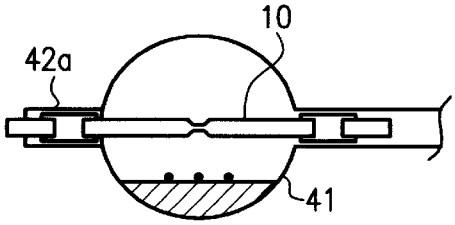

Process 7
(process of adding the emission substances and the like)

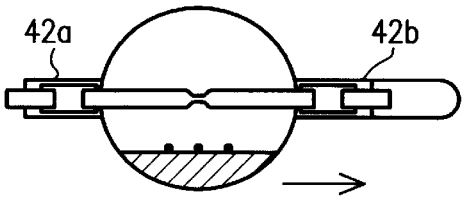

Process 8
(process of second sealing)

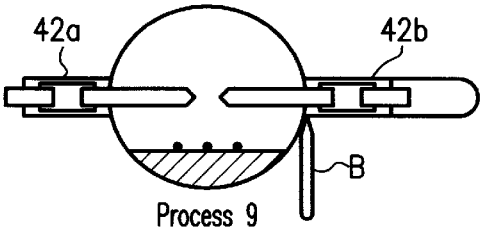

Process 9
(process of regulating the size of the distance between the electrodes)

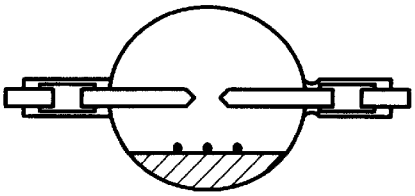

Process 10
(process of cutting a side radius)

FIG. 3

DISCHARGE LAMP OF THE SHORT ARC TYPE AND PROCESS FOR PRODUCTION THEREOF

BACKGROUND OF THE INVENTION

1. Field of the Invention

The invention relates to a discharge lamp in which there are a pair of electrodes in an arc tube.

2. Description of Related Art

As light sources for general illumination, industrial endoscopes, overhead projectors, and liquid crystal back lights, metal halide lamps are used which are a type of discharge lamp.

In the following, a process for production of a conventional metal halide lamp is described using FIG. 5.

(Process of electrode machining)

Electrodes of tungsten or the like are machined by means of a lathe or the like. In doing so, tips and parts of the electrode to which metal foils are later welded are shaped. In the drawing, an electrode 1 has been given a conically shaped tip 100 while a part 110 at the opposite end of the electrode which has had a flat shaped thereon.

(Process of electrode treatment)

Electrodes 1 machined in the above described manner are subsequently subjected to electrolytic polishing and cleaning, and furthermore, are degassed in a vacuum heating furnace.

(Process of attaching mounts)

To one end of molybdenum foil 2, an outer lead 3 is welded, while to the opposite end of the foil 2, the electrode 1, which has been treated in the above described manner, is welded. An assembly comprised of electrode 1, molybdenum foil 2 and outer lead 3 is called a "mount," and in the drawing, the mount is labelled with reference letter C.

(Process of production of an arc tube)

An arc tube of fused silica glass 4 has a bulb essentially in its middle, this bulb being intended to form the emission space.

(Process of insertion of the mount)

Mounts C are inserted into arc tube 4 and located at a distance to one another in order to obtain the desired distance between the electrodes.

(Process of sealing)

Next, arc tube 4 is turned. Heat is supplied to the outside of the regions provided with the molybdenum foils 2, and thus, hermetic sealing is obtained. In doing so, at the same time, control of the distance between the electrodes, the eccentricity of the electrodes and the like, is performed using a magnifier or CCD camera. After completion of hermetic sealing, the length of the distance between the completed electrodes is recorded.

(Process of filling)

Next, filler is added to arc tube 4 through a tube 5. Fillers are, for example, halides in the form of a pellet, for example, $SnI_2$. Here, it is necessary that the amount of filler is matched to the length of the distance between the electrodes so that the electrical characteristic is always constant. After adding the filler, outlet tube 5 is sealed and thus the lamp is completed.

However this production process has the following disadvantages:

The sealing process is performed manually using a lathe or the like to obtain an exact distance between the electrodes. This process is performed using a magnifier, CCD camera or the like such that the distance is visually matched. It is therefore difficult to always achieve an exact distance.

The sealing process is furthermore performed such that the arc tube is turned around its longitudinal direction. It is therefore necessary to control the eccentricity of the electrodes. In reality, therefore, the lamps have small deviations in the distance between the electrodes. The corresponding amount of filler to be added can, therefore, only be adjusted after measuring the distance between the electrodes in the respective lamp. In particular, recently the distance between the electrodes has become extremely short, i.e. it is no more than 3.0 mm. The indicated problem therefore becomes particularly pronounced in such situations.

Furthermore, there is the disadvantage that, in this production process, neither mass production nor automation are possible.

To eliminate these disadvantages the present inventor has already devised an invention which has been disclosed in Japanese patent disclosure document HEI 6-310030.

In this production process, hermetic sealing of the mounts is performed in the state in which the two electrodes are joined to one another. Afterwards, through a tube (hereinafter also called filling tube), a rod is inserted. With this rod a slot is punched which has been arranged beforehand on the upholding parts of the electrode connected to one another. Thus, the distance between the electrodes is adjusted. Based on this technology, the distance between the electrodes is produced after the mounts are sealed. Therefore, an exact distance between these electrodes can always be established.

However, in the process which is disclosed in the above described prior art, it is necessary for producing the distance between the electrodes to insert a rod through a tube formed on the bulb of the arc tube. Therefore, on the outside surface of the arc tube of the completed lamp, there necessarily remains a residual part of the tube (generally called a tip).

Recently, because the emission space has become smaller and smaller, the effects of the tip have therefore become less and less negligible. Specifically, due to the presence of the tip, the effective radiation surface on the outside surface of the lamp is accordingly reduced. Furthermore, scattered light which is formed by the tip is emitted in the form of undesirable radiation onto the screen and the like.

SUMMARY OF THE INVENTION

Therefore, a primary object of the present invention is to devise a so-called tipless discharge lamp of the short arc type in which there is no tip on the outside surface of the arc tube and in which there is an exact distance between the electrodes.

The above object is achieved in accordance with the invention, in a discharge lamp of the short arc type, by a pair of electrodes being located in an arc tube, by to some extent fracture traces being present on the faces of these electrodes which are caused by thermal expansion and contraction of the electrode material, and by none of the filling tube remaining on the outside surface of the arc tube. The fracture traces on the electrodes of the invention are not subjected to mechanical working, such as cutting, polishing or the like.

In a discharge lamp of the short arc type in which in an arc tube has an emission space bordered on each of opposite sides by a hermetically sealed portion, there is a pair of electrodes arranged such that the first end of the electrode projects into the emission space and the second end is located in one of the hermetically sealed portions, the object of the invention is furthermore achieved by the fact that, in at least one of the hermetically sealed portions, in a region in which the second end of the electrode is attached, the outside diameter is less than the outside diameter of the remaining region of the hermetically sealed portion, and that, on the outside surface of the arc tube, there is no residual portion of the filling tube.

A process for producing the discharge lamp of the short arc type in accordance with the invention is characterized by the following process steps.

(1) A single electrode component which has a recess essentially in its middle area is placed in a tube of fused silica glass in which a bulb is formed in the middle which is intended to form the emission space. One of the ends of the electrode component is hermetically sealed.

(2) From the other end, predetermined emission substances are added to the bulb which is designed to form the emission space.

(3) This other end is hermetically sealed by heating. Thus, a hermetically sealed emission space is formed.

(4) In the heating of this other end, the electrode component and the fused silica glass each expand with different coefficients. By subsequent cooling cracks form in the recess of the electrode part, causing the latter to separate. Proceeding from this state at least one of the hermetically sealed portions is heated again. While or after heating this hermetically sealed portion, the fused silica glass in this hermetically sealed portion and the electrode inserted therein are drawn together toward the outside. Thus, the desired distance between the electrodes is produced.

The object is furthermore achieved in accordance with the invention, in a discharge lamp of the short arc type, by the recess, which has become brittle due to expansion and cooling, being irradiated with a laser from outside the fused silica glass in above described process step (4) when the electrode component has not been fully severed, and by this measure, the one-piece electrode component is cut.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 3 depicts the process steps for producing a metal halide lamp of the short arc type according to the invention;

DETAILED DESCRIPTION OF THE PREFERRED EMBODIMENTS

In the discharge lamp of the short arc type according to the invention, the arc tube is sealed in a state in which there is a single slotted electrode component formed of two coupled electrodes, while in the conventional production process two electrodes are sealed individually within the arc tube. Specifically, in accordance with the invention, one end of the arc tube is sealed, emission metals such as mercury and the like are added, and afterwards the other end is sealed. In this way, in the interior a hermetically sealed emission space is formed. When the other end is sealed, due to the very different coefficients of thermal expansion of the fused silica glass forming the arc tube and the metal forming the electrode component, for example, tungsten, cracks form in the slot of the electrode component when sealing and cooling are performed. The separation in this area takes place by the natural phenomenon of expansion and contraction of the electrode component.

Proceeding from this state, at least one of the hermetically sealed portions is re-heated and the electrode together with the fused silica glass in its vicinity is drawn toward the outside. In this way, the desired distance between the electrodes is produced.

By means of this new production process, a so-called tipless lamp can be obtained in which there is no tip on the outside surface of the arc tube because the arc tube bulb does not require the provision of a filling tube. Thus, an exact distance between the electrodes can be achieved. Furthermore, mass production of a lamp of this type and automation are enabled.

In the discharge lamp of the short arc type according to the invention, the electrodes are produced using a natural phenomenon, that is, by expansion and cooling of the electrode component. The faces of the electrodes therefore have fracture traces without having undergone machining, such as cutting, polishing, or the like.

With the invention, after separation of the electrode component, at least one of the electrodes together with the fused silica glass surrounding it is drawn outwardly in order to achieve the desired distance between the electrodes. The base point of the electrode therefore has an area with a smaller diameter which was formed by drawing to the outside after the process of hermetic sealing.

Figure 1:
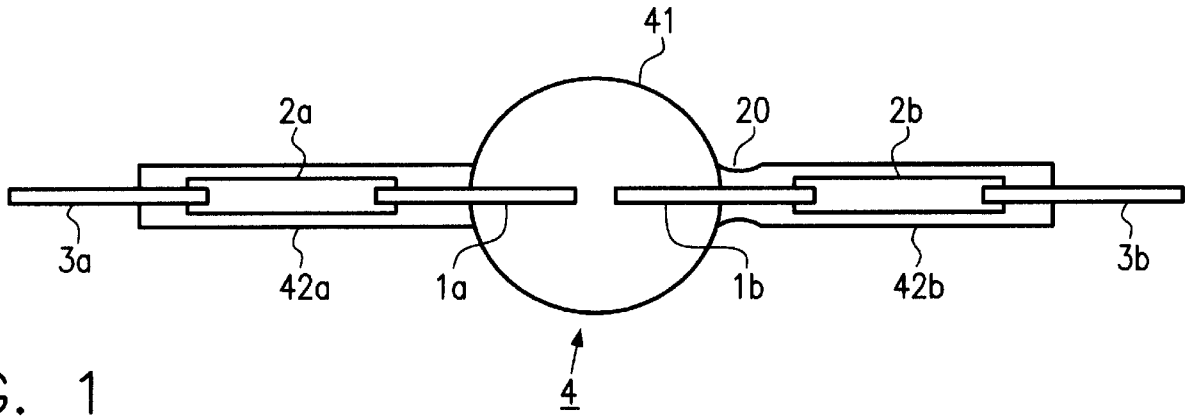
FIG. 1 is a schematic view of a metal halide lamp of the short arc type according to an embodiment of the invention.

FIG. 1 schematically shows a discharge lamp of the short arc type in accordance with the invention in which an arc tube 4 made of fused silica glass has an emission space formed within a bulb 41 and has a pair of hermetically sealed portions 42. The emission space within bulb 41 has an internal volume of, for example, 0.05 $cm^3$ and is essentially spherical in shape. In the emission space, there is a pair of opposed electrodes 1*a*, 1*b* (hereafter, referred to collectively as electrodes 1). The distance between the two electrodes 1 is, for example, 1.4 mm. The electrodes 1 are made of tungsten and have an outer diameter of 0.4 mm. One end of each of the electrodes 1 is joined to a molybdenum foil 2*a*, 2*b* (hereafter, referred to collectively as molybdenum foils 2). Outer leads 3*a*, 3*b* (hereafter, referred to collectively as outer leads 3) are joined to the molybdenum foils 2. In the emission space, mercury and halides are added as the emission substances, and furthermore, a rare gas, such as argon or the like, is added as the starting gas. As halides, specifically, dysprosium, indium, neodymium, tin, cesium, and/or cerium and the like are added in the form of bromides and/or iodides.

Figure 2:
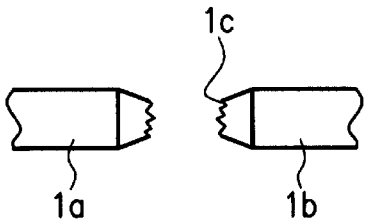
FIG. 2 is an enlarged view of the electrodes of the metal halide lamp shown in FIG. 1.
Figure 5:
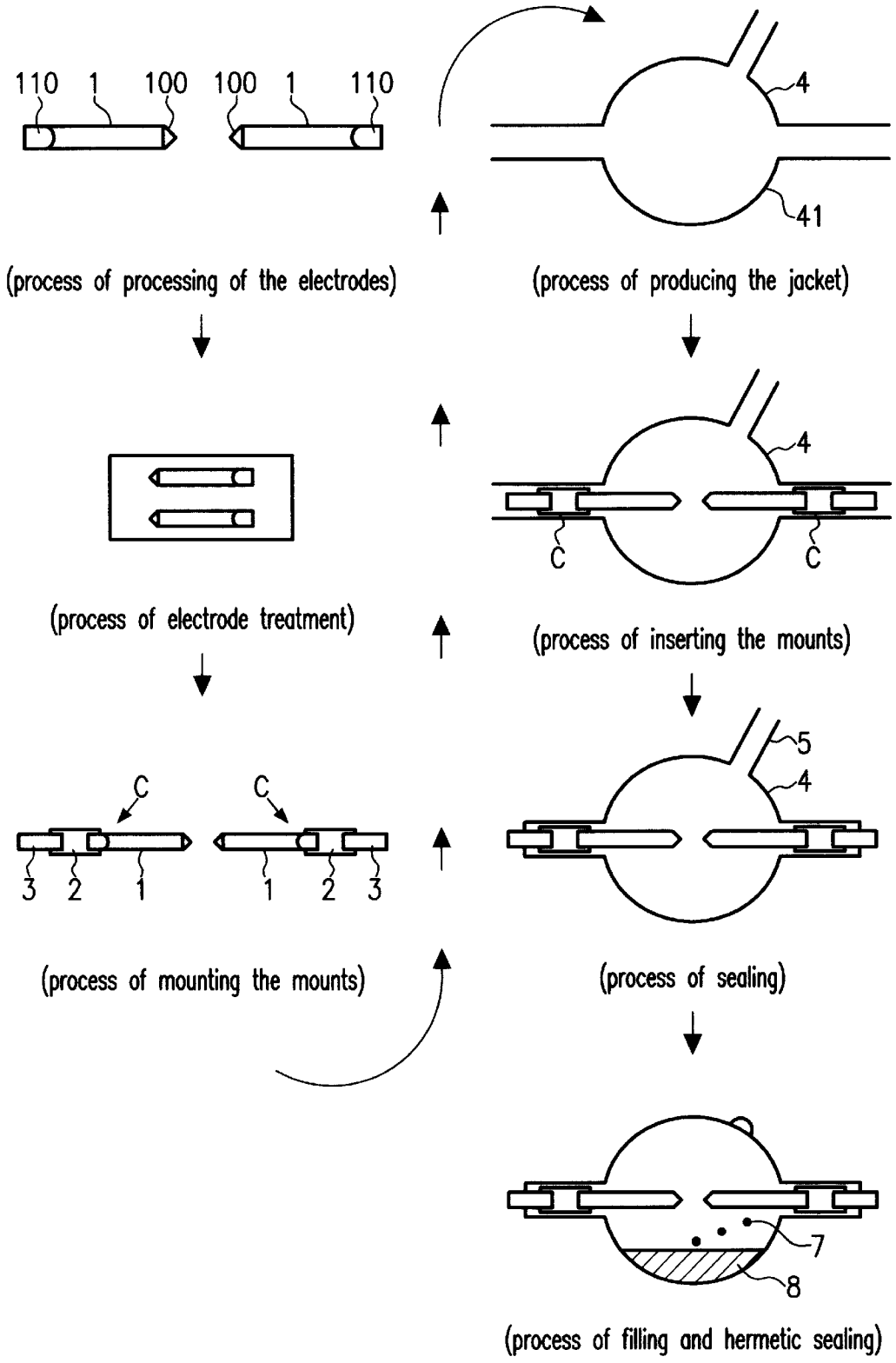
FIG. 5 (Prior Art)
FIG. 5 shows a schematic of the conventional process for producing a metal halide lamp of the short arc type.

Electrodes 1, as is shown in FIG. 2, to some extent have fracture traces Ic on their tips and these fracture traces are not subjected to machining, such as cutting, polishing, or the like. The reason for this is that, after arranging the one-piece electrode component in the arc tube and after sealing the two hermetically sealed portions, separation of the electrode component into two electrodes is produced, as is described below with respect to the production process. This means that treatment, such as polishing of the electrode tips beforehand or the like, as was described with respect to the prior art, is not performed.

The shape and size of these fracture traces 1*c* are, however, different and differ depending on the state and conditions of the natural separation described below. There are cases in which only extremely small fracture traces are present, and possibly also cases in which the fracture traces disappear after operation of a few hours.

The discharge lamp of the short arc type according to the invention, furthermore, has an area in at least one of the hermetically sealed portions which has a smaller diameter, as is shown in FIG. 1, This reduction in diameter is caused by re-heating of the corresponding hermetically sealed portion and by joint drawing of electrode 1*b* and the fused silica glass of sealed portion 2*b* in its vicinity to the outside, as is described below with respect to the production process. It is preferred that the smaller diameter area 20 be located between the emission space and molybdenum foil 2*b*. This is because heating of the molybdenum foil is not desirable due to possible oxidation, or for similar reasons is not desirable when smaller diameter area 20 is reheated in its production with a torch. The diameter of smaller diameter area 20 is, for example, about 5 mm to 6 mm less than the normal outside diameter of the hermetically sealed portions 2.

FIG. 3 schematically shows a process for producing the discharge lamp of the short arc type according to the invention.

(Step 1: electrode processing)

In single, one-piece electrode component 10 of pure tungsten or thorium-containing tungsten, a recess 11 is formed by a grinder G or the like. The size of the recess is essentially fixed such that electrode component 10 does not break. Instead of grinder G, a wire cutter or lathe can be used.

On the two ends of electrode component 10, flat parts 110 are formed which are used for welding of the molybdenum foils. The term "electrode component" is defined, in the context of the present invention, as a component in which two electrodes are "coupled together" as parts of a onepiece assembly. The term "electrode" is used hereinafter only to refer the individual electrodes formed when the electrode component is separated.

(Step 2: electrode treatment)

Electrode component 10 is subjected to electrolytic polishing and cleaning. Furthermore, this electrode component 10 is placed in a vacuum heating furnace so as to remove impurities from it as gas. Here, it is advantageous that degassing in a vacuum heating furnace is performed, for example, at a temperature of 1500° C. for five minutes, that is, essentially at a temperature and for a time at which weak recrystallization will take place in the recess 11 machined beforehand. This is because the weak recrystallization of the recess simplifies the separation of the electrode component described below. For recrystallization, instead of a vacuum heating firnace, irradiation of the recess with laser light can be used. As a source of laser light, a $CO_2$ laser, YAG laser or the like can be used.

(Step 3: attachment of the mount)

One outer lead 3, made of a molybdenum rod or a tungsten rod, at a time is welded to an outer end of the molybdenum foils 2 which have been cut to a given form, while a respective end of the electrode component 10 (which has been subjected to electrode treatment) is welded to the other end of each of the molybdenum foils 2. The assembly of electrode component 10, molybdenum foil 2 and outer lead 3 is called a mount and is labeled A in the drawing.

(Step 4: producing the arc tube)

Arc tube 4 of fused silica glass is formed in such a way that the thickness of the fused silica glass is measured so that the inside volume of the emission space becomes constant. The overall outside shape is formed by means of a split die. In this way, a bulb 41, which encloses the emission space, is produced with hermetically sealed portions 42 on opposite sides. In doing so, the inside diameter of hermetically sealed portions 42 is fixed on the two ends in such a way that it approaches the widths of molybdenum foil 2 as closely as possible.

(Step 5: Process of installing the mounts)

Mounts A, as assembled in step 3, are inserted into arc tube 4. Recess 11 of electrode component 10 is located essentially in the middle of the emission space with consideration of the drawing apart of the electrodes described below.

(Step 6: Process of initial sealing)

According to the invention, first one of the hermetically sealed portions 42, in this case, hermetically sealed portion 42*a*, is sealed in a per se known manner. Specifically, the base of hermetically sealed portion 42*a* of arc tube 4 is mechanically squeezed, inert gas ($N_2$) being added through the two openings of arc tube 4.

(Step 7: Process of adding the emission substance and the like)

Emission substances, such as mercury, metal halides and the like, and rare gas and the like are added through the opening of the other, not yet hermetically sealed, part 42*b* of the arc tube 4. In this case, the solid emission substances are added in the form of pellets by a pellet doser. For example, tin halide is added as the metal halide.

(Step 8: Process of second sealing)

The portion 42*b* which is still open is now hermetically sealed. Here, first the emission substances which are added to the emission space are cooled by liquid nitrogen or water. This is intended to prevent these emission substances from vaporizing as a result of the temperature rise.

Proceeding from this state, squeezing of the base is performed in the same way as in the process of initial sealing. The sealing temperature is, for example, roughly 2200° C. to 2300° C. Here, the coefficient of thermal expansion of the tungsten which forms electrode component 10 differs significantly from the coefficient of thermal expansion of the fused silica glass which forms arc tube 4. Electrode component 10 therefore expands in the direction shown by an arrow in FIG. 3, step 8. After completion of step 8, both of the portions 42*a*, 42*b* are hermetically sealed.

Accordingly, there is the tendency for electrode component 10 to contract during cooling. Cracks form in recess 11 and due to this natural phenomenon separation of the electrode component 10 into two electrodes takes place. This is based on the greatly differing coefficient of thermal expansion of the tungsten and fused silica glass, as was described above. Specifically, at 2200° to 2300° C., the coefficient of thermal expansion of tungsten is $70\times10^{-7}$ cm/° C., while the coefficient of thermal expansion of the fused silica glass is $7\times10^{-7}$ cm/° C. The two coefficients of thermal expansion therefore differ from one another by an order of magnitude.

Due to the above described different coefficients of thermal expansion, in electrode component 10, after completion of the second sealing step, complete separation generally takes place in the area of recess 11 due to natural phenomena. However, if in the exceptional case complete separation does not take place, separation by irradiation with a laser or the like from the outside of arc tube 4 can be effected after completion of the process of second sealing.

It has been found that the electrode component, if it is in a brittle state due to the treatment according to the invention, can be separated by laser beams. If, however, the treatment according to the invention using the different coefficients of thermal expansion of tungsten and fused silica glass is not performed and a brittle area in the electrode component is not produced, separation by laser beam, while theoretically possible, in reality cannot be used. This is because, as a result of the high temperature of the laser light, blackening of the fused silica glass is caused; this was confirmed by the experiments of the inventor.

(Step 9: Process of regulating the size of the gap between the electrodes)

One hermetically sealed portion, e.g., portion 42*b* is reheated. Heating is produced in the hermetically sealed portion using burner B with a relatively thin flame, preferably in the region between the area in which the molybdenum foil is inserted, and the emission space. If the fused silica glass is melted in this way, in the heated area, electrode 1*b* is drawn outwardly in such a way that the heated fused silica glass is entrained. Thus, the desired distance between the electrodes is fixed. The heating temperature here is, for example, 2000° C. This temperature can be lower than the temperature in squeezing of the base. It is sufficient if the fused silica glass is melted until the electrode can be moved toward the outside.

(Step 10: Completion)

Last, the two hermetically sealed portions are brought into their final form and the lamp is thus completed.

Figure 4:
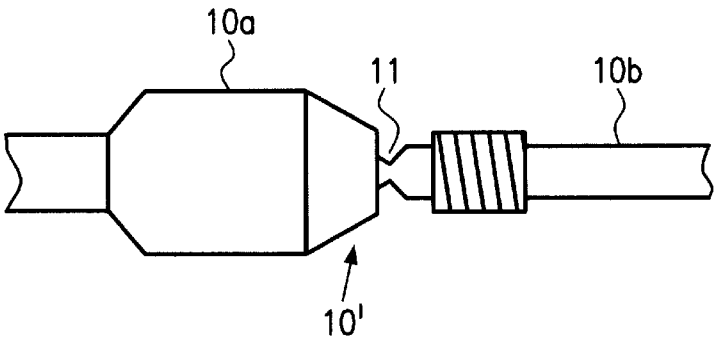
FIG. 4 is a schematic illustration of a DC type of metal halide lamp of the short arc type according to the invention.

The above described embodiment is an example of a discharge lamp for AC operation in which the two electrodes have the same size and shape; but, the invention can also be used for a discharge lamp for DC operation. In this case, one-piece electrode component 10' is used as shown by way of example in FIG. 4. Here, a portion 10*a* which is to comprise the anode, and one portion 10*b* which is to comprise the cathode, are coupled to one another via recess 11.

Action of the Invention

In the discharge lamp of the short arc type in accordance with the invention, sealing is performed between the electrodes and the arc tube in the state in which, first of all, the electrodes are joined as parts of a one-piece electrode component, while in the conventional production process two electrodes are joined individually to the arc tube. Specifically, with the invention, one end of the arc tube is sealed, emission metals, such as mercury and the like are added, and afterwards the other end is sealed. In this way, a hermetically sealed emission space is formed inside the arc tube. When the second end is sealed, due to the very different coefficients of thermal expansion of the fused silica glass which forms the arc tube and the metal, such as tungsten, which forms the electrode component, cracks form in the recessed area of the electrode component when sealing is completed and cooling is performed. Proceeding from this region separation of the electrode component into two separate electrodes takes place by natural phenomena.

Thereafter, at least one of the hermetically sealed portions is heated again and the electrode located in the heated portion, together with the fused silica glass in its vicinity, is drawn in an outward direction. Thus, the desired distance between the electrodes is produced.

A so-called tipless lamp in which, on the outside surface of the arc tube, there is no tip can be produced by this new production process. An exact distance between the electrodes can be achieved. Furthermore, mass production of a lamp of this type and automation are enabled.

In the discharge lamp of the short arc type of the invention, separation of the electrodes is produced by a natural phenomenon, that is, by expansion and cooling of the electrode component. The faces of the electrodes, therefore, have fracture traces which have not undergone machining, such as cutting, polishing, or the like.

Furthermore, with the invention, after separation of the electrode component, at least one of the electrodes together with the fused silica glass in its vicinity is drawn outwardly in order to achieve the desired distance between the electrodes. The base point of the electrode, therefore, has an area with a smaller diameter which was formed by drawing to the outside after the process of hermetic sealing.

What we claim is:

1. Discharge lamp of the short arc type having a pair of electrodes in an arc tube, wherein the electrodes are fracture-split parts of an originally one-piece electrode component, facing ends of the electrodes having faces which, to at least to some extent, exhibit fracture traces caused by fracturing of the electrode material due to thermal expansion and contraction effects; and wherein an outside surface of the arc tube is free of residual filling tube projections.

2. Process for producing a discharge lamp of the short arc type, comprising the steps of:

(1) a) placing a one-piece electrode component which has a recess essentially in its middle area in a tube of fused silica glass which has a first end and a second end between which a bulb is provided which forms an emission space of the discharge lamp;

b) hermetic sealing the first end of the fused silica glass tube in a manner enclosing a first end of the electrode component in a hermetically sealed manner;

(2) adding emission substances into the bulb via the second end of the tube;

(3) hermetic sealing the second end of the fused silica glass tube to produce a hermetically sealed emission space with the application of heat in a manner enclosing a second end of the electrode component and causing the electrode component and the fused silica glass to expand in different amounts due to differing coefficients of thermal expansion thereof; and (4) a) cooling the second end in a manner forming cracks in the electrode component in an area of the recess;

b) heating at least one of the hermetically sealed ends of the fused silica glass tube in the area in which an end of the electrode component is hermetically enclosed; and c) outwardly drawing at least one heated end of the fused silica glass tube together with one end of the electrode component to position one of the two electrodes at a stipulated distance from the other.

3. Process for producing a discharge lamp of the short arc type as claimed in claim 2, wherein following step (4) a), the area of the recess of the electrode component is irradiated from outside of the fused silica glass tube with laser light to completely separate the electrode component.

* * * * *